United States Patent [19]

Keklak et al.

[11] 4,008,730

[45] Feb. 22, 1977

[54] AIRCRAFT SHELTER AND RIGGING

[76] Inventors: Ronald Keklak, 637 Church St., Amston, Conn. 06231; Hubert H. Loewenhardt, 20 Robin St., Pawcatuck, Conn. 02891

[22] Filed: Oct. 20, 1975

[21] Appl. No.: 624,303

[52] U.S. Cl. ..... 135/5 R; 52/63; 52/83; 135/7.1 R; 135/8

[51] Int. Cl.[2] ..... E04B 1/342; E04B 1/347; E04H 6/44

[58] Field of Search ..... 135/1 R, 7.1 R, 5 R; 52/63, 66, 83, 126, 222, 237, 148, 641

[56] References Cited

UNITED STATES PATENTS

| | | | |
|---|---|---|---|
| 36,483 | 9/1862 | Ricketson | 135/15 CF |
| 1,871,101 | 8/1932 | Waltz | 135/15 CF |
| 2,511,974 | 6/1950 | Finken et al. | 135/1 R |
| 2,520,655 | 8/1950 | Pomerance | 52/83 |
| 2,880,741 | 4/1959 | McGrand | 135/1 R |
| 3,234,695 | 2/1966 | Johnson | 135/1 R |
| 3,601,944 | 8/1971 | Shepherd | 135/7.1 R |

*Primary Examiner*—Thomas F. Callaghan
*Assistant Examiner*—Conrad L. Berman
*Attorney, Agent, or Firm*—D. Paul Weaver

[57] ABSTRACT

A lightweight economical and portable structure for small aircraft includes fixed upright tail and wing tip posts and a lightweight generally horizontal boom extending forwardly from the tail post bisecting a line between the two wing tip posts. Cross arms parallel to the boom are secured to the wing tip posts. A similar cross arm extending at right angles to the boom is attached to the tail post. From the ends of the cross arms and points on the boom, the structure is rigged with rope and strong lightweight fabric is cut, sewn and laced on the rope rigging and is supported thereby in overhead relationship to an aircraft beneath it on the ground. Additional wing booms may be suspended beneath the wing covering fabric sections for added stability.

9 Claims, 6 Drawing Figures

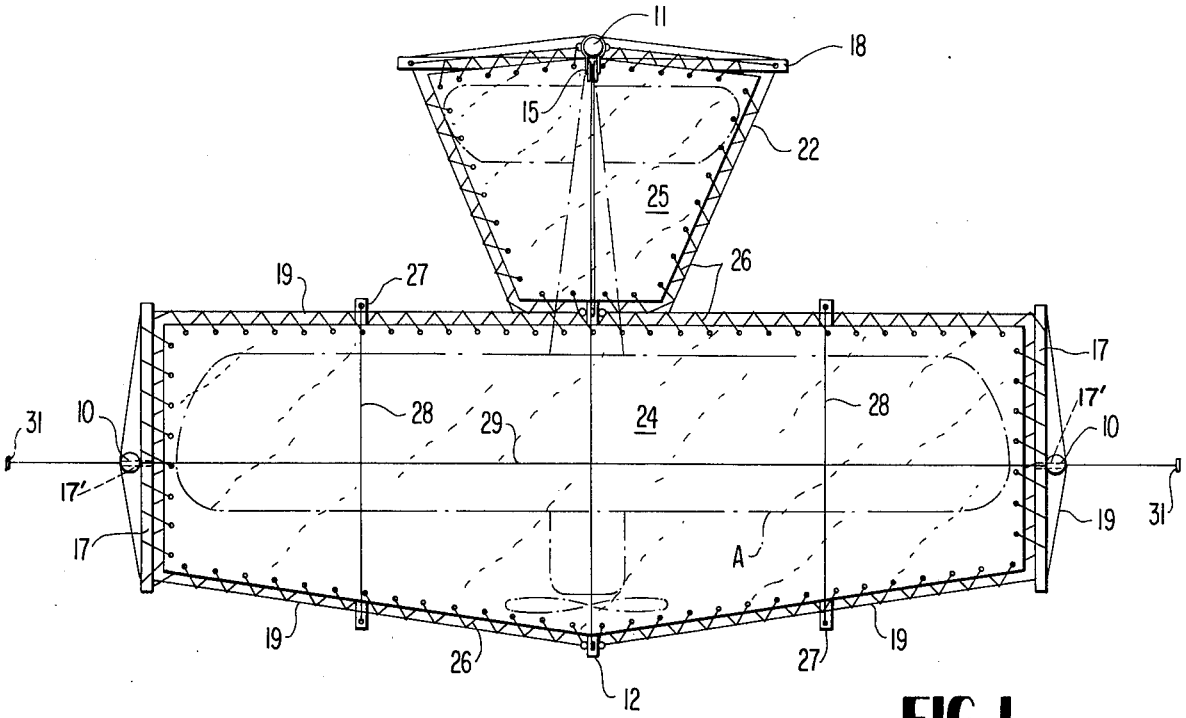
FIG. 1
FIG. 2
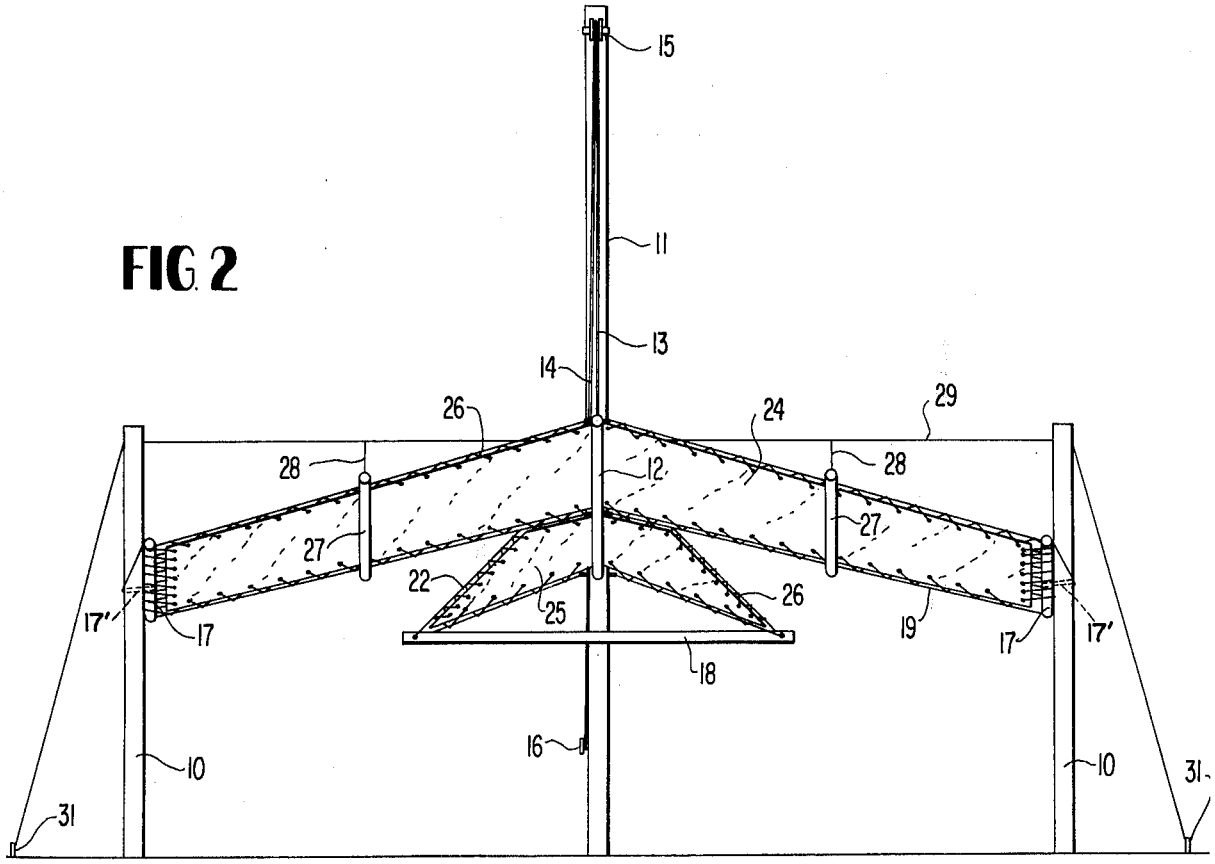

AIRCRAFT SHELTER AND RIGGING

BACKGROUND OF THE INVENTION

A need exists for a safe inexpensive year-round portable shelter for small fixed wing aircraft, as distinguished from conventional permanent shelters constructed from wood, sheet metal and fiberglass. The latter types of shelters are prohibitively expensive to construct and maintain and do not satisfy the need on which this invention is based.

The prior patented art contains some teachings relative to portable lightweight aircraft shelters and examples of the prior art are found in U.S. Pat. Nos. 2,778,369; 3,234,695; 2,511,974 and 3,601,944 and other patents. While these prior patents disclose generally workable arrangements, their teachings have not been adopted commercially because of practical considerations. In general, the patented structures are too complex and costly for commercial acceptance and require labor and skill in constructing beyond the degrees acceptable to owners of small lightweight aircraft.

With the above deficiencies of the prior art in mind, this invention seeks to provide a greatly simplified, wholly practical, safe and inexpensive lightweight portable shelter for aircraft which will truly meet the needs of the art as discussed previously. More particularly, the invention seeks to provide a shelter for aircraft formed of economical and durable materials which can be erected with a minimum of expense and labor at any desired location and can be easily dismantled when the need for the shelter no longer exists or in the presence of extreme weather conditions.

Other advantageous features of the invention will become apparent during the course of the following detailed description.

BRIEF DESCRIPTION OF DRAWING FIGURES

FIG. 1 is a plan view of an aircraft shelter embodying the present invention.

FIG. 2 is a front elevational view thereof.

DETAILED DESCRIPTION

Figure 3:
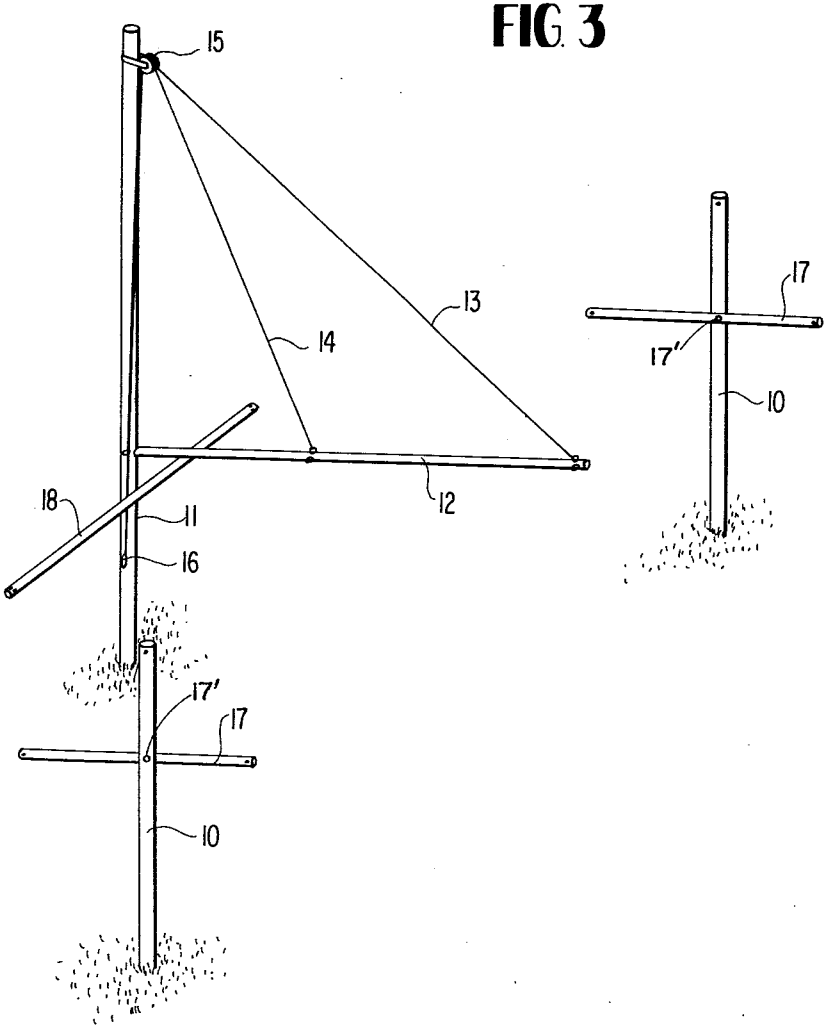
FIG. 3 is a perspective view of basic support elements employed in the invention.

Referring to the drawings in detail wherein like numerals designate like parts, and referring first to FIG. 3, the numerals 10 and 11 designate side or wing tip support posts and an intermediate rear or tail support post. The three posts are suitably anchored in the ground and are upright. The tail post 11 is about twice the height of wing tip posts 10 and is located midway between them and spaced rearwardly thereof in a triangular array. The upright posts 10 and 11 may be similar to conventional telephone poles.

A substantially horizontal boom 12 preferably formed of PVC pipe or equivalent lightweight plastic extends forwardly of the tail post 11 at a height somewhat above the elevation of the aircraft tail. The rear end of boom 12 is suitably fixed to the post 11 and the boom extends somewhat forwardly of the two wing tip posts 10 and bisects a line between them. The boom 12 is suspended above the aircraft by ropes 13 and 14 having corresponding ends secured to the boom 12 near its forward tip and near its midpoint, FIG. 3, the ropes extending over a fixed guide sheave 15 near the top of pole 11 and having their other corresponding ends adjustably held by a fitting 16 on the tail post 11 near its lower end. By this means, the boom 12 may have its forward end adjusted upwardly or downwardly to meet the needs of a particular installation, the rear end of the boom being adapted to pivot relative to the post 11.

Cross arms 17 are pivotally attached as at 17' to the side or wing tip posts 10 in parallel relation to the boom 12 and at elevations on the posts 10 somewhat above the wing tips of the aircraft to be sheltered. These cross arms 17 are somewhat wider than the aircraft wing, see FIG. 1, where the aircraft is indicated beneath the shelter at A. Similarly, a horizontal cross arm 18 is attached to the tail post 11 at a slightly lower elevation than the boom 12 and extends at right angles to the boom. The cross arm 18 extends equidistantly on opposite sides of tail post 11 and is somewhat longer than the width of the aircraft tail, as shown in FIG. 1.

Figure 4:
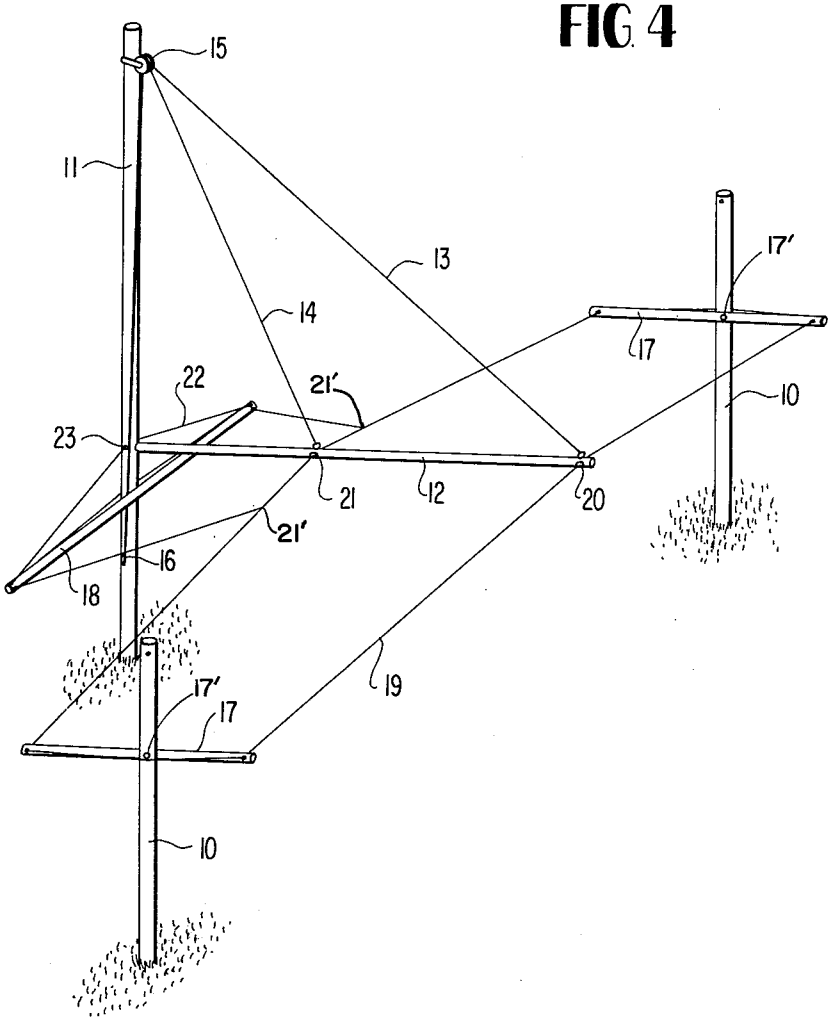
FIG. 4 is another perspective view, similar to FIG. 3, showing rope rigging.

Referring to FIG. 4, a rope rigging 19 for the wing area extends from the ends of the two wing tip cross arms 17 to points 20 and 21 on the boom 12 near its forward tip and midpoint. Similarly, rope rigging 22 for the tail area of the shelter extends from the ends of cross arm 18 to points 21' of the rope rigging 19 and to a connecting point 23 on tail post 11 somewhat above horizontal cross arm 18.

Figure 5:
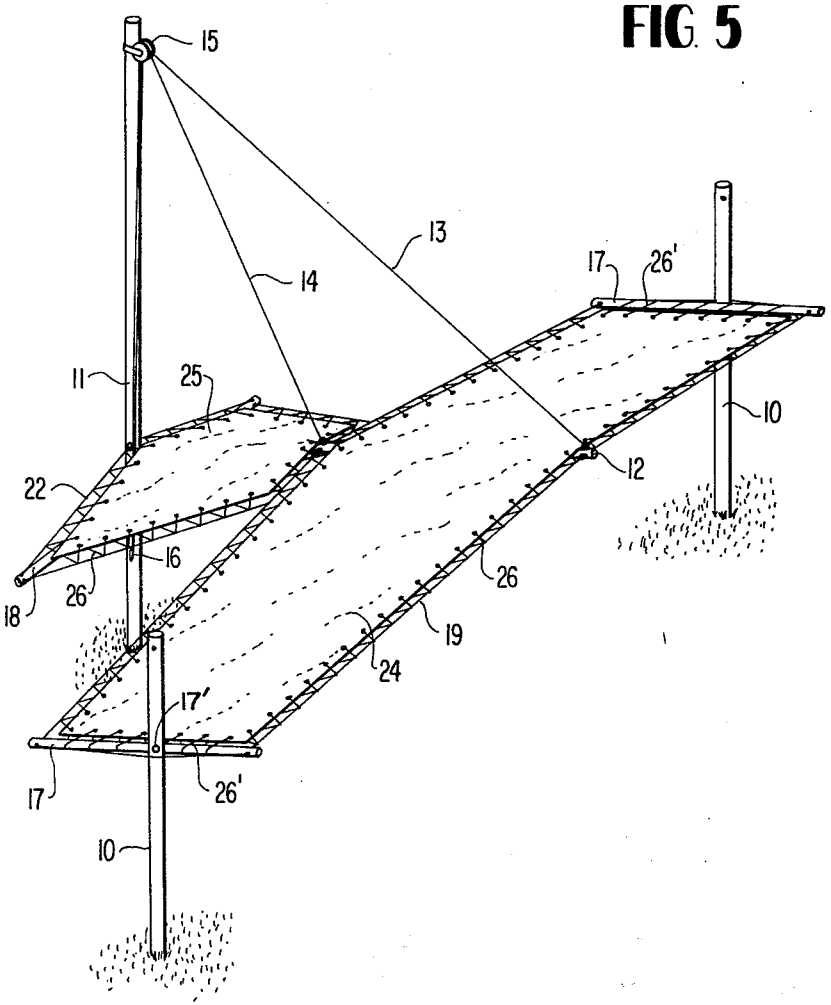
FIG. 5 is a similar perspective view showing the application of protective fabric to the rigging.

After the installation of this rope rigging, FIG. 5, wing and tail area fabric sections 24 and 25 having their margins secured by lacing 26 to the rope riggings 19 and 22 and to the cross arms 17 in the case of wing section fabric 24, as indicated at 26', FIG. 5. The fabric sections 24 and 25 extend over the boom 12 which constitutes the primary support for the center of the fabric structure, in cooperation with the rope rigging means 19 and 22.

Figure 6:
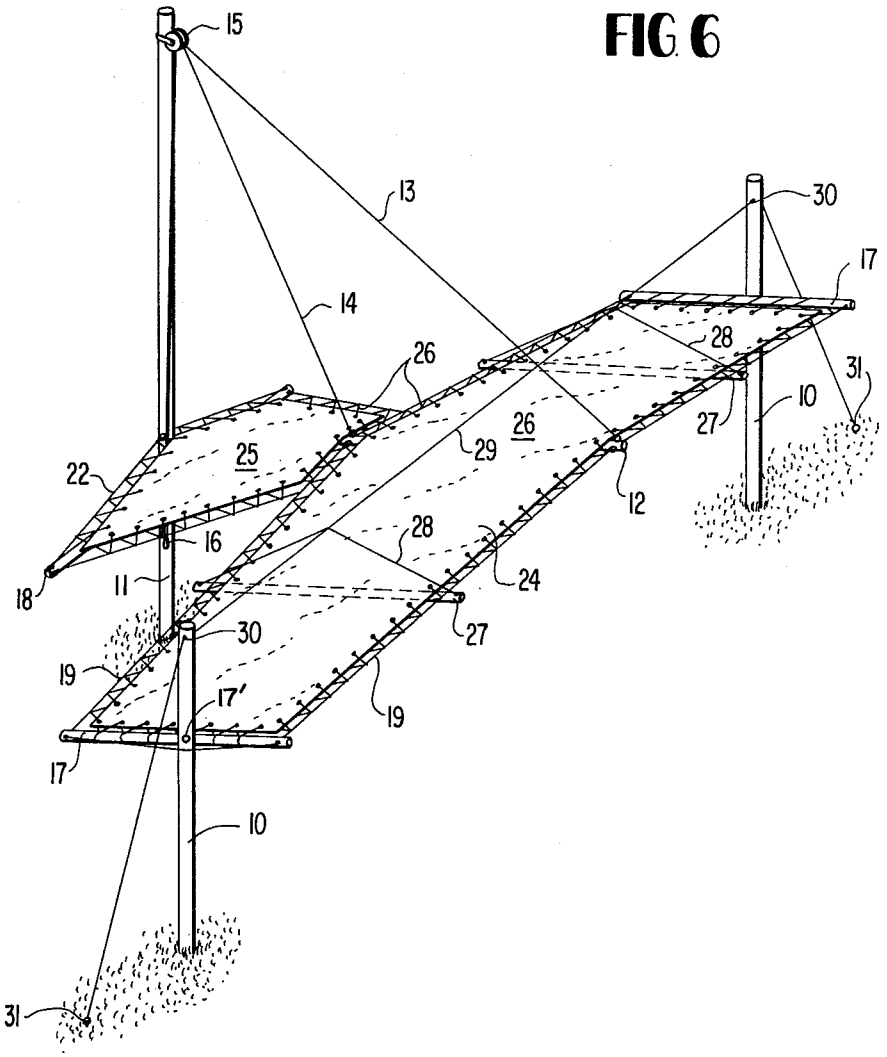
FIG. 6 is a perspective view of the completed shelter including additional suspended wing area support booms.

The shelter, thus far described, is illustrated in FIG. 5 and may be utilized in this form to shelter the aircraft A. However, for added stability and safety, as illustrated in FIG. 6, additional wing area support booms 27 are preferably employed beneath intermediate points of the wing fabric section 24 on opposite sides of the main boom 12 in equidistantly spaced parallel relationship to the main boom 12. These additional booms 27 are suspended by rope harnesses 28 from an overhead transverse horizontal guy rope 29 passing through openings 30 near the tops of wing tip posts 10 and having its opposite ends ground anchored at 31, laterally outwardly of the posts 10. In addition to lending support to the shelter at the wing covering region, the booms 27 will act as a fail-safe means, since they are suspended from the side posts 10 independently from the main boom 12.

In the unlikely event that the shelter should collapse on the aircraft below it, the craft would not be damaged because of the lightweight nature of the plastic booms 12 and 27.

The fabric sections 24 and 25 are preferably formed of nylon reinforced vinyl material sold under the trade name "Herculite". Other equivalent types of fabric may be employed.

When final adjustments of the rope rigging have been made, the side cross arms 17 and the main boom 12 will slope downwardly and rearwardly somewhat toward the tail of the aircraft as best illustrated in FIG. 2. Secondary booms 27 will also assume automatically the same sloping positions.

The resulting shelter is entirely free of obstructions within the area encompassed by the three posts 10 and 11 and below the fabric and rope rigging. The entire front of the shelter between the side posts 10 is open.

The simplicity of the shelter and its many advantages and economies in comparison to the prior art should be apparent to those skilled in the art without the necessity for further description herein.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. An aircraft shelter comprising a pair of fixed upstanding wing tip posts and a single tail post arranged in a triangular array with the single tail post extending for a substantial distance above ground level, a generally horizontal boom disposed substantially midway between said wing tip posts and having its rear end attached to the tail post at an intermediate elevation on the tail post, cross arms on the wing tip posts near the elevation of said boom and substantially parallel to the boom, a single cross arm on said tail post near the elevation of said boom and substantially at right angles thereto, rope suspension means for said boom on said tail post and stabilizing the forward end of the boom, generally horizontal rope rigging interconnecting said boom with the cross arms of the wing tip posts, additional generally horizontal rigging connected with the cross arm of the tail post and the first-named rigging, and fabric aircraft wing and tail area coverings secured to said riggings, said boom underlying said fabric coverings.

2. The structure of claim 1, and a transverse guy rope extending between the tops of the wing tip posts and above and across the wing area fabric covering, and a pair of secondary booms substantially parallel to said boom arranged beneath intermediate points on the wing area fabric covering and being suspended from said guy rope and supporting said fabric covering independently of said boom.

3. The structure of claim 2, and rope harnesses secured to the ends of said secondary booms and extending over the top of said guy rope being supported by the latter.

4. The structure of claim 3, and said guy rope having ground anchored opposite ends.

5. The structure of claim 1, and at least said boom constructed of lightweight plastic.

6. The structure of claim 1, and said rope suspension means for said boom comprising a pair of rope strands having corresponding ends secured to the forward tip and an intermediate point on said boom, an elevated guide sheave for said rope strands on said tail post near the top thereof, and a rope securing fitting on said tail post near the bottom thereof adapted to secure said rope strands adjustably.

7. The structure of claim 1, and the means for securing said fabric coverings to said rope riggings consisting of lacing at the margins of said coverings lashed around said rope riggings means.

8. The structure of claim 7, and said lacing additionally lashed around said wing tip post cross arms.

9. The structure of claim 1, and said boom having its rear end pivotally anchored to said tail post, and said cross arms on the wing tip posts being pivoted whereby they may be adjusted in concert with said boom by said rope suspension means for said boom to a desired degree of slope downwardly and rearwardly.

* * * * *